United States Patent [19]

Hanson et al.

[11] Patent Number: 4,845,494

[45] **Date of Patent: * Jul. 4, 1989**

[54] METHOD AND APPARATUS USING CASING AND TUBING FOR TRANSMITTING DATA UP A WELL

[75] Inventors: Merle E. Hanson, Livermore; Paul F. Titchener, Menlo Park, both of Calif.

[73] Assignee: Comdisco Resources, Inc., San Francisco, Calif.

[ * ] Notice: The portion of the term of this patent subsequent to Oct. 14, 2003 has been disclaimed.

[21] Appl. No.: 605,832

[22] Filed: May 1, 1984

[51] Int. Cl.[4] ..... G01V 1/00; E21B 47/022

[52] U.S. Cl. ..... 340/857; 340/856; 166/65.1; 166/206; 324/367

[58] Field of Search ..... 73/151; 181/105; 267/1.5; 324/347, 355, 356, 357, 368, 367, 374; 340/853, 856, 857; 367/81, 35, 911; 166/65 R, 65.1, 66, 113, 187, 206-208

[56] References Cited

U.S. PATENT DOCUMENTS

| | | | |
|---|---|---|---|
| RE. 21,102 | 5/1939 | Jakosky | 324/356 |
| 1,804,078 | 5/1931 | Baden . | |
| 1,991,658 | 2/1935 | Clark et al. | 73/151 |
| 2,217,857 | 10/1940 | Byck . | |
| 2,225,668 | 12/1940 | Subkow et al. | 404/72 |
| 2,242,612 | 5/1941 | Leonardon | 73/154 |
| 2,310,757 | 2/1943 | Wagner . | |
| 2,350,832 | 6/1944 | Segesman | 177/311 |
| 2,400,170 | 5/1946 | Silverman | 340/856 |
| 2,476,137 | 7/1949 | Doll | 166/21 |
| 2,567,507 | 9/1951 | Brown . | |
| 2,826,736 | 3/1958 | Doll | 324/2 |
| 2,955,458 | 10/1960 | Sonnier et al. | 73/40.5 |
| 3,024,658 | 3/1962 | Huddelston, Jr. | 73/362 |
| 3,434,046 | 3/1969 | Wilson et al. | 324/221 |
| 3,437,992 | 4/1969 | Johnston | 340/856 |
| 3,454,870 | 7/1969 | Lintelman et al. | 324/10 |
| 3,478,584 | 11/1969 | Strubhar et al. | 73/155 |
| 3,568,053 | 3/1971 | Kilpatrick | 324/347 |
| 3,620,300 | 11/1971 | Crowson . | |
| 3,732,728 | 5/1973 | Fitzpatrick et al. | 73/151 |
| 3,758,731 | 9/1973 | Vann . | |
| 3,900,827 | 8/1975 | Lamel . | |
| 3,957,409 | 10/1962 | Grossman, Jr. | 166/242 |
| 4,035,763 | 7/1977 | Cowles | 340/856 |
| 4,178,579 | 12/1979 | McGibbens et al. | 340/857 |
| 4,182,159 | 1/1980 | Churchman | 73/40.5 |
| 4,236,113 | 11/1980 | Wiley | 166/187 X |
| 4,286,217 | 7/1981 | Planche et al. | 324/347 |
| 4,413,679 | 11/1983 | Perkins . | |
| 4,433,724 | 2/1984 | Nagano . | |
| 4,461,172 | 7/1984 | McKee et al. | 73/155 |
| 4,484,627 | 11/1984 | Perkins | 166/65.1 X |
| 4,522,262 | 6/1985 | Perkins . | |
| 4,553,226 | 11/1985 | Scherbotskoy | 367/83 |
| 4,616,702 | 10/1986 | Hauson et al. | 340/356 |
| 4,724,434 | 2/1988 | Hauson et al. | 340/857 |

*Primary Examiner*—Brian S. Steinberger
*Attorney, Agent, or Firm*—Christie, Parker & Hale

[57] ABSTRACT

Method and apparatus for transmitting data uphole in a well to the top of the well. A string of electrically conductive tubing and a tool connected to the tubing are lowered down the well along the inside of tubular shaped electrically conductive casing for the well. The inside of the casing is electrically contacted with an electrical contact carried by the tool. A switch in the tool is operated for alternately electrically connecting and disconnecting the contact and thereby the casing and with respect to the conductive tubing for changing the electrical conductance between the tubing and the casing representative of data. The changing conductance is interrogated with an alternating current, formed at the top of the well, to recover the data.

18 Claims, 6 Drawing Sheets

182
AC SIGNAL SOURCE
184
186
186a
186b
R1
R2
R3
194
192
196
198
190
202
188
200
204
FILTER
206
ANALOG TO DIGITAL CONVERTER
208
MICRO-COMPUTER
210
DISPLAY
20a
26
42
32
18
16
12
24
36
20b
34
32
14
30
28

METHOD AND APPARATUS USING CASING AND TUBING FOR TRANSMITTING DATA UP A WELL

CROSS REFERENCES TO RELATED APPLICATIONS

This application is copending with U.S. patent applications which disclose common subject matter, as follows:

U.S. patent application Ser. No. 06/606,473 entitled METHOD AND APPARATUS USING A WELL CASING FOR TRANSMITTING DATA UP A WELL, in the names of Paul F. Titchener, Merle E. Hanson, and U.S. patent application Ser. No. 06/606,472 entitled A TOOL AND COMBINED TOOL SUPPORT AND CASING SECTION FOR USE IN TRANSMITTING DATA UP A WELL, in the names of Paul F. Titchener, Merle E. Hanson, and Clifford W. Hamberlin, now U.S. Pat. No. 4,616,702. and U.S. patent application Ser. No. 06/605,834 entitled METHOD AND APPARATUS USING CASING FOR COMBINED TRANSMISSION OF DATA AND FLUID FLOW IN A GEOLOGICAL FORMATION in the names of Paul F. Titchener, Merle E. Hanson, now U.S. Pat. No. 4,724,434 all of which were filed on even date herewith.

BACKGROUND OF THE INVENTION

1. Field of the Invention

The present invention relates to borehole telemetry systems and more specifically to a casing/tubing arrangement for transmitting data up a well such as an oil or gas well.

2. Brief Description of the Prior Art

Various techniques have been used for sensing parameters, such as pressure, temperature, inclination, etc., downhole in oil and gas wells and for obtaining data about the parameters uphole.

Parameters have been sensed and recorded on strip chart recorders downhole. A problem with this technique is that the recording device must be brought back uphole to be read and, therefore, the parameter being sensed cannot be monitored uphole on a real-time basis.

Techniques have been developed for measuring parameters and transmitting data about the parameters uphole on a real-time basis. One technique is referred to as the soda straw technique in which a small tube extends down in the well casing from the top of the well to the bottom zone where pressure is sensed. An instrument is used to sense the pressure at the top of the tube which gives a measure of bottom hole pressure. Disadvantages of this technique are the high cost and time required to run in and remove the tube from the well, the danger that the tube will create problems with fracturing fluid, increased pressure required to force fluids down the casing due to the introduction of the tube, and high fluid pressure at the top of the well, creating the likelihood of a blowout. These problems are likely to occur when fracturing fluids are pumped between the casing and tubing.

Another technique is one where mud pulses are used to create data pulses in the mud being pumped downhole and the data pulses are sensed uphole. The bits of information per unit time is quite low with this technique and the devices are generally costly and mechanically complex.

Wire line techniques are used where electrical signals are transmitted uphole on a wire or electrical conductor. However, this requires a special wire extending from the surface to the bottom of the hole. Examples of such methods are described in Leonardon, U.S. Pat. Nos. 2,242,612, Cowles, 4,035,763, Wilson et al., 3,434,046, Planche et al., 4,286,217, and Jakosky, RE. 21,102.

Other techniques are known for transmitting electrical signals to the top of the well which do not require a wire line. Examples of these techniques will now be discussed.

In an article in the IEEE, "Transactions on Geoscience and Remote Sensing", Vol. GE-20, No. 2, April 1982, J. Bhagwan and F. N. Trofimenkoff, report an electric drill stem telemetry method. Bhagwan et al. describe the use of a main drill stem and a downhole electrode electrically isolated from the main drill stem for transmitting data from downhole to the surface. The main drill stem and the downhole electrode comprise a portion of an electrical circuit, the balance of which includes a distant electrode placed in the earth, a conductor connecting the main drill stem to the distant electrode, and a current path through the earth between the distant electrode and the main drill stem and isolated electrode. Two methods of telemetry are discussed. The first is a resistance change method wherein the main drill stem and the isolated downhole electrode are alternately connected and disconnected while the resultant resistance change due to the connection or disconnection is monitored at the earth's surface. In the second method, a signal from a downhole signal source is applied between the downhole electrode and the main drill stem, and received by a receiving electrode, placed between the main drill stem and the earth at the surface.

The Bhagwan article is largely theoretical in nature and is deficient in technical details. Several difficulties arise with the first or resistance method. For example, a separate drill stem is required in the cased well. Also, a bottomhole electrode, electrically separated from the drill stem, must somehow be positioned downhole but Bhagwan does not say how this would be done. Also if resistance is measured at the top of the hole using an ohm meter, ohm meters typically employ D.C. signals which would cause polarization along the drill stem. Also Bhagwan teaches that this approach would be difficult to do under field conditions that are normally encountered in drilling or testing situations.

With Bhagwan's downhole signal method, provision must be made downhole for a source of power adequate to transmit signals uphole for substantial periods of time and is not desirable for downhole equipment which must remain downhole for substantial periods of time.

Silverman, U.S. Pat. No. 2,400,170, shows a drill pipe containing an insulated section separating the main drill pipe from the drill collar and drill bit. Electrical waves are transmitted through make and break contacts from the insulated section through the surrounding earth to sensor electrodes located uphole on the surface.

Other methods of telemetry are known for producing an electrical signal downhole and radiating the signal through the earth to sensors located uphole at the surface. Such are the U.S. Pat. Nos. 1,991,658 to Clark et al., 1,991,658 and to Subkow et al., 2,225,668.

Johnston, U.S. Pat. No. 3,437,992, discloses a self-contained downhole parameter signaling system of the type which generates signals downhole for transmission and detection uphole. Johnston discloses a complicated power generating system which uses the movement of a sucker rod connected to a pump and a transformer for generating electrical power downhole for the instrument package. Using the generated power, a circuit applies electrical impulses, representative of downhole parameters such as pressure or temperature, to the primary of a transformer, the secondary of which is connected between the tubing and casing. The connection to the casing is made through a sleeve, which is insulated from the tubing, and outwardly movable leaf spring contacts which engage and electrically connect to the inside of the casing. The impulses which are transferred from the primary to the secondary of the downhole transformer create electrical signals which travel up the tubing and casing to an uphole transformer. The uphole transformer amplifies the signals for conversion to usable form at the top of the well. As a result, Johnston is quite complicated.

Drilling strings are also known with nonconductive sections for electrically separating the drill string into upper and lower electrically conductive drill strings to allow the radiation of signals to the top of the well such as disclosed in *Oil & Gas Journal,* Feb. 21, 1983, pp. 84–90.

A large source of power is required to maintain both the last two mentioned downhole equipment.

SUMMARY OF THE INVENTION

A method and apparatus are disclosed herein for transmitting data uphole in a well to the top of the well. A string of electrically conductive tubing and a tool connected to the tubing are lowered down the well along the inside of tubular-shaped electrically conductive casing for the well. The inside of the casing is electrically contacted with an electrical contact carried by the tool. A switch in the tool is operated for alternately electrically connecting and disconnecting the contact, and thereby the casing, to the conductive tubing for changing the electrical conductance between the tubing and the casing representative of data. An electrical alternating current signal, formed at the top of the well, is used to interrogate the changes in conductance from and recover the data.

With this arrangement, wirelines and expensive downhole power generating sources are not required. There is no need to apply electrical power downhole to be passed uphole. Additionally a packer is easily modified to carry the contacts.

DETAILED DESCRIPTION

Figure 1:
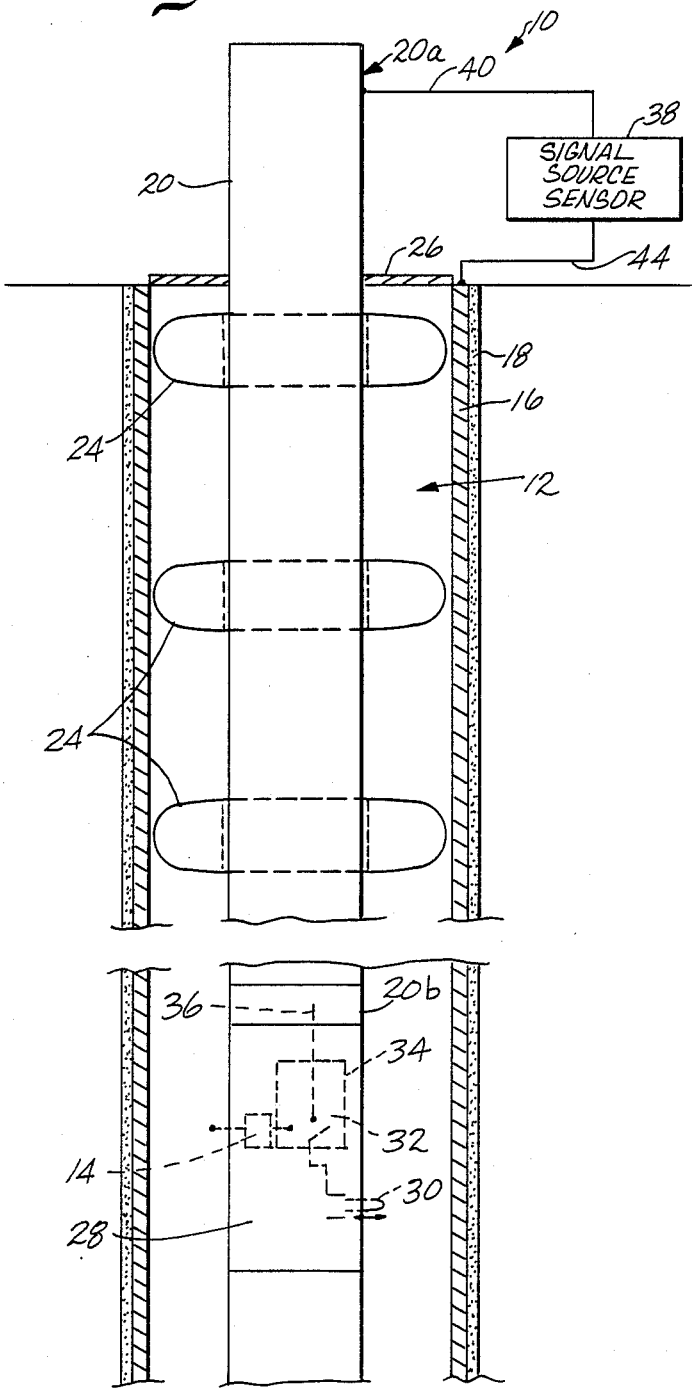
FIG. 1 is a schematic and cross-sectional view of casing in an oil or gas well and a schematic and side elevation view of a tubing string connected to means for electrically contacting the casing in a data communication system and embodying the present invention.

FIG. 1 shows an apparatus 10 for communicating digital information in an oil or gas well 12 uphole from a downhole sensor 14. The well 12 may be a new well for which information or data is sought from the bottom of the borehole, or an old well. The well may be used for secondary recovery methods for recovery of hydrocarbons or for fracturing a geological formation. In such cases, various parameters such as pressure or temperature are required from down the well.

An electrically conductive tubular-shaped casing 16 is provided in the well formed from a string of pipe or casing sections as is well known in the well art. The casing is cemented in the well 12 by cement 18. In the present invention, casing 16 may be a new casing that is quite deep or the applied fluid pressures are quite high. Also the casing may be an old casing which has deteriorated to a point where the structural integrity of the casing downhole is unknown. To protect the casing from the pressurized fluid, a string of tubing is added and extends down the casing to a position below a packer, between the tubing and casing that seals the casing above off from the pressurized fluid exiting the tubing below. This tubing, rather than the casing, then takes the high pressure.

To this end, an electrically conductive tubing string 20 extends inside the casing from an upper end **20*a* at the top of the well to a lower end which is connected to a conductive coupler 20*b*. Multiple sections of tubing with threaded connectors between each section are used to make up the tubing string but are only schematically illustrated in FIG. 1** for simplicity.

The tubing 20 is electrically separated from the casing 16 by conventional ring-shaped centralizers 24 which are made non-conductive. The ring-shaped centralizers 24 are placed about the tubing string 20 as the tubing is made up and run in the well to prevent electrical contact between the casing and tubing. Also a nonconductive cap 26 is placed at the upper end of the casing 16 about the tubing string 20 to electrically isolate the tubing 20 from the casing 16.

The relative proportions in the schematic of FIG. 1 with respect to the tubing, spacers and casing are exaggerated for illustration.

A tool 28 is supported by the coupler 20*b* and carries an electrical contact 30 adapted for moving radially out into electrical contact with the inside of the casing. The tool 28 includes a sensor for sensing a parameter in that area of the well in which the tool 28 is placed. Preferably, the sensor is a pressure sensor 14 for sensing the pressure in the annulus between the casing and tubing.

A switch 32, preferably in the tool 28, alternately and electrically couples and decouples the tubing 20 to the electrical contact 30 causing changes in the electrical conductance between the casing and tubing representative of data. Although the switch 32 is preferably contained within the tool, it may be located elsewhere depending on the particular design. As shown in FIG. 1, the switch 32 25 has one side of its input/output circuit coupled to the lower end 20*b* of the tubing string 20 by a conductor 36 and the other side electrically connected to contact 30.

Signal source and sensor unit 38 at the top of the well applies an alternating current (AC) signal between the tubing and the casing.

An electronic circuit 34, in which the switch 32 is located, controls the opening and closing operation of switch 32 in accordance with the signals from the pressure sensor 14 and therefore causes changes in conductance between casing and tubing and hence changes in the signal in the casing and tubing representative of pressure data.

The unit 38 also includes means coupled at the top of the well to at least one of the tubing and the casing for sensing the changes in signal, for determining the changes in conductance and for recovery of the pressure data. The unit 38 is coupled to the coupler 20*b* by conductor 40. The unit 38 is also coupled to the casing 16 at coupling 42 through a conductor 44.

The signal source in one embodiment of unit 38 is a constant voltage AC source connected between the upper portion 20*a* of the tubing string 20 and the upper end of the casing 16. The changes in conductance between tubing and casing cause changes in current flow in the tubing and casing. A current sensor is provided in unit 38 for sensing the changes in signal and to recover the pressure data.

Alternatively, the unit 38 has a constant current AC source coupled between the upper portion 20*a* of casing 16 and the tubing string 20. The signal as applied between the casing 16 and tubing 20 for sending a signal along casing 16 and tubing 20. As a result of the alternate coupling and decoupling through switch 32 of the casing 16 and tubing string 20, through contact 30, the voltage between the casing and tubing varies and is representative of pressure data. With this embodiment, a voltage sensor, preferably coupled through a separate pair of leads (not shown) to the upper portion 20*a* of the tubing string 20 and to the the casing 16, is provided in unit 38 to sense the changing voltage signal representative of pressure data.

Figure 2:
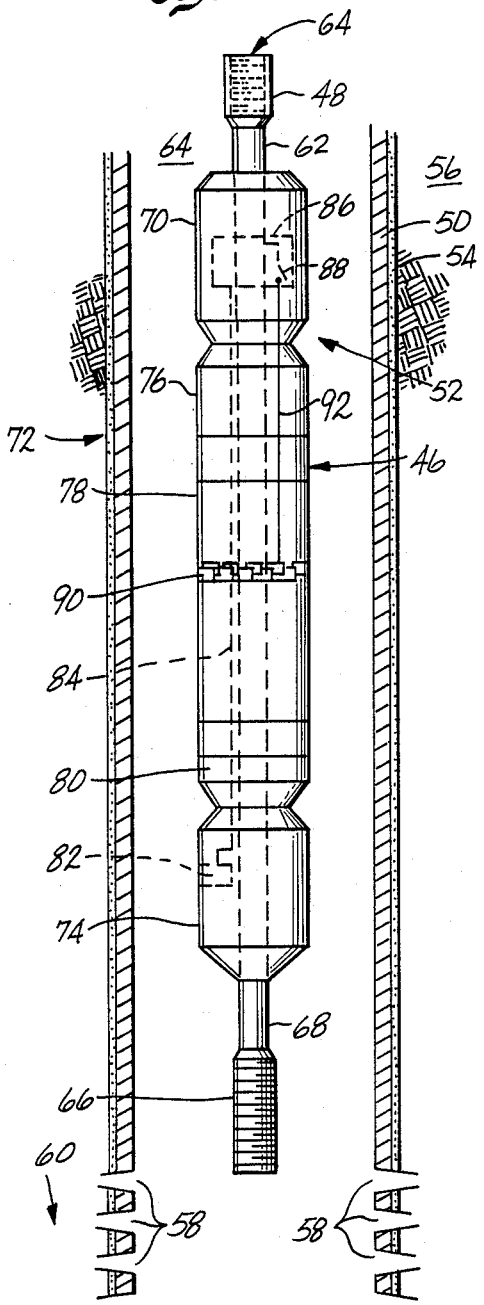
FIG. 2 is a schematic and cross-sectional view of casing in an oil or gas well and a schematic and side elevation view of an uninflated packer adapted with a contact for electrically contacting the casing in a data communication system and embodying the present invention.

FIG. 2 depicts a preferred embodiment of the invention in which the tool forms part of a packer. The upper end of packer and contacting tool 46 is supported by the lower end of a tubing string (not shown) through an internally threaded tubing coupling 48 at the top of the tool. The tool 46 is positioned and extends within a casing 50 cemented in a well 52 by cement 54. The casing 50 extends within the earth 56 to perforations 58 adjacent a hydrocarbon producing zone 60 in a surrounding geological formation.

A tubular-shaped mandrel 62 has a central passage 64 extending from the threaded coupling 48 along the length of the tool 46 to externally threaded coupling 66 which is for connecting to another tool or a lower tubing string 46. Oriented about mandrel 62 and between threaded couplings 48 and 66 is the main portion of tool 46 comprising an electronics housing 70, an inflatable packer 72 with contacts and a sensor housing 74.

The electronics housing 70 is generally cylindrical-shaped and oriented coaxially about a top portion of mandrel 62. The electronics housing 70 has a sufficiently small outer diameter to allow insertion of the tool 46 into the inside passage of casing 50 without having the tool 46 hang up as it is lowered through the casing. Preferably, the electronics housing 70, sensor housing 74, and packer 72 include inwardly extending bevelled portions at their ends for preventing lodgement of debris.

Figure 3:
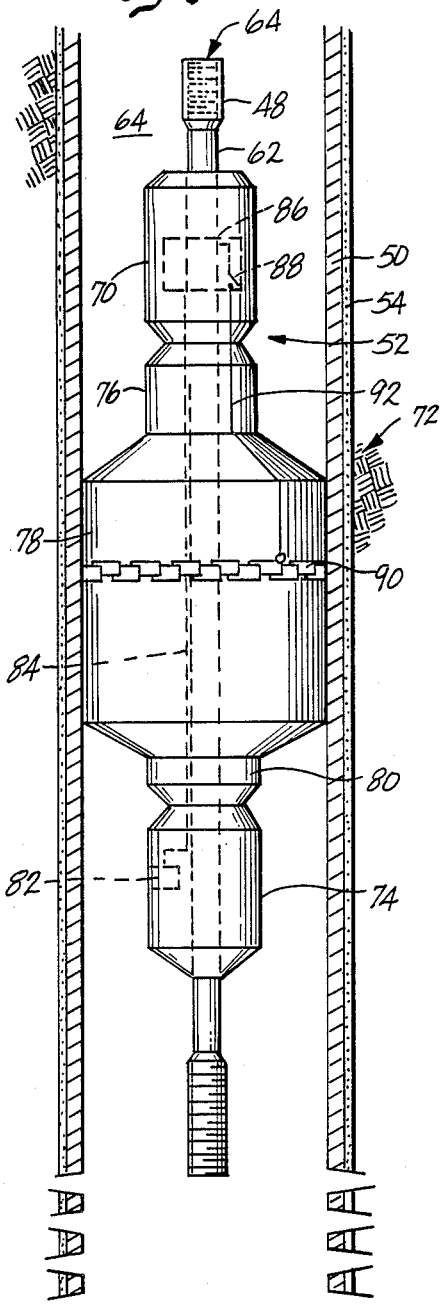
FIG. 3 is a schematic view similar to FIG. 2 showing the packer inflated.

Directly below the electronics housing 70 is the packer 72 oriented coaxially about a mid-portion of mandrel 62 for packing off the casing. Preferably, the packer is cylindrical in shape, circular in cross section, and in a deflated condition, has a cross-sectional area perpendicular to the drawing substantially equal to that of electronics housing 70. The upper portion 76 and lower portion 80 of the packer 72 are preferably made from rigid supporting material for supporting the ends of the inflatable element 78. The packer 72 may be similar in structure and function to the production injection packer marketed by Lynes, under product No. 300-01. The inflatable element 78 is preferably composed of a flexible electrically non-conductive rubber bladder with internal steel reinforcing material (not shown) and is adapted to be extended outward as seen in FIG. 3 responsive to fluid pressure in the inside passage of mandrel 62.

Below packer 72, oriented coaxially about a lower portion of mandrel 62, is the sensor housing 74 having a configuration similar to the electronics housing 70.

The sensor housing 74, preferably, contains a pressure sensor 82 similar to the sensor described in FIG. 1. The sensor is placed below the packer 72 since the pressure to be sensed is in the area adjacent perforations 58 and producing zone 60 and below the packer 72. The sensor 82 is coupled through conductors 84 extending upwardly from sensor housing 74 preferably adjacent and parallel to mandrel 62 through the inside of packer 72 and into electronics housing 70 to electronics circuit 86. The electronics circuit 86 includes a switch 88 similar in structure and function to that described with respect to the switch of FIG. 1.

Circumferential contacts 90 are oriented in a ring about the circumference of the non-conductive inflatable element 78 for electrically contacting the casing 50 when the inflatable element 78 is actuated or inflated outward to pack off the casing 50. Adjacent circumferential contacts 90 are preferably overlapping such that electrical contact is maintained between adjacent overlapping contacts when the inflatable element 78 is inflated to the packed configuration.

The circumferential contacts 90 are coupled through a conductor 92 to the switch 88 in electronics circuit 86. The conductor 92 may extend along the outside surface of packer 72 and electronics housing 70 or may pass inside either or both of packer 72 and electronics housing 70 along mandrel 62.

Referring now to FIG. 3, when high fluid pressure is applied in the passage of mandrel 62, the inflatable element 78 inflates and expands radially outward until contact is made by both the inflatable elements 78 and contacts 90 with the adjacent portion of the conductive casing 50. Poppet valves (not shown) are actuated to maintain the inflated configuration of inflatable element 78.

The sensor supplies analog data signals to electronic circuit 86 representative of pressure. The data signals are converted in electronic circuit 86 to digital form for contact of the opening and closing of switch 88. AC signals are applied between the casing and tubing. Therefore, the opening and closing of switch 88 connects together and disconnects the tubing (via mandrel 62) and the casing (via conductor 92 and contact 90) changing conductance therebetween representative of the pressure data.

Figure 4:
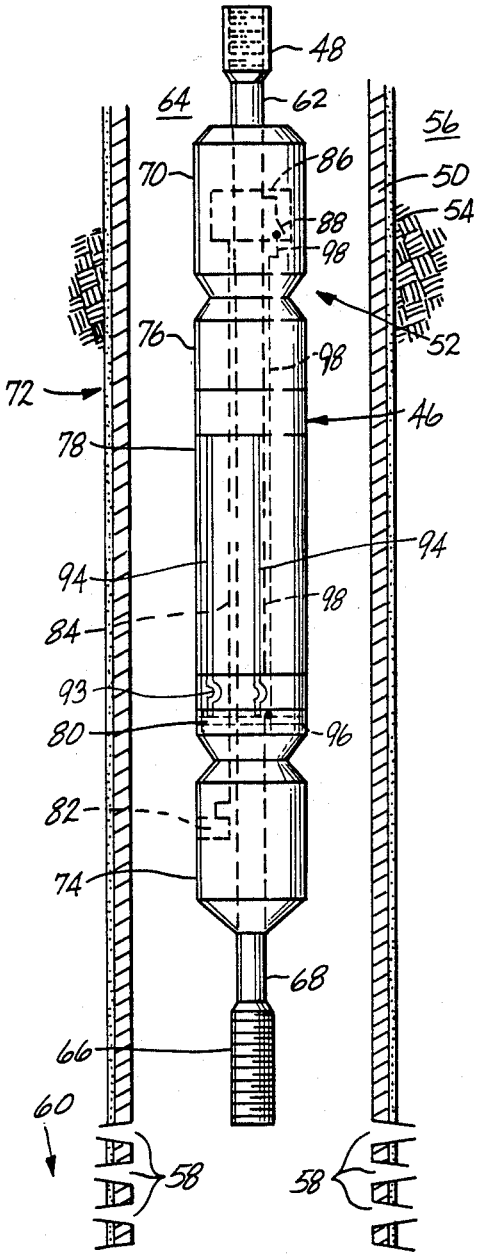
FIG. 4 is a schematic and cross-sectional view of casing in an oil or gas well and a schematic and side elevation view of an uninflated packer with an alternate contact arrangement contacting the casing in a data communication system and embodying the present invention.
Figure 5:
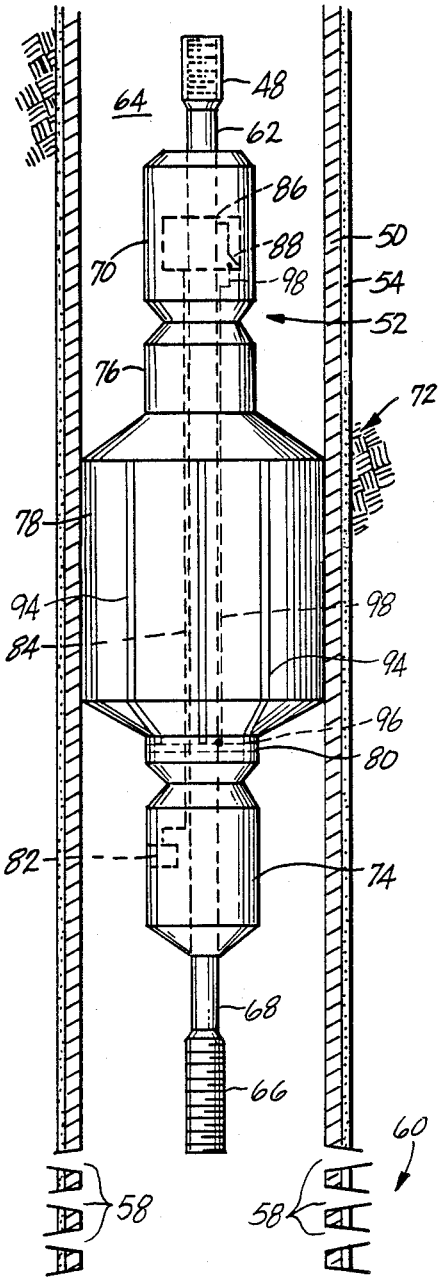
FIG. 5 is a schematic and side elevational view similar to that of FIG. 4 showing the packer actuated.

A preferred embodiment of a tool 46 combined with a packer with contacts is shown in FIGS. 4 and 5. The parts in FIGS. 4 and 5 are essentially the same as FIGS. 2 and 3 except as otherwise described and the same element reference numerals are used for the same parts. The circumferential contacts 90 of FIGS. 2 and 3 are replaced with upwardly or axially extending wires or contacts 94. There are a plurality of essentially parallel and elongated axial contacts 94 all attached at different positions on and around the inflatable element 78. The inflatable element 78 is rubber or other non-electrical conductive material which electrically isolates the contacts from the conductive part of the tool such as the housing parts 70, 76 and 74 and mandrel 62.

The axial contacts 94 are retained from below on the inside of a fiber ring 96 which also electrically insulates the axial contacts 94 from the conductive portions of tool 46. The lower ends of the contacts are all connected together by a conductive wire or ring 80 inside of fiber ring 96. The axial contacts 94 extend upwardly from the fiber ring 96 in an axial direction parallel to mandrel 62 away from fiber ring 96 along the surface of inflatable element 78. The axial contacts have a function similar to the circumferential contacts 90 described with respect to FIGS. 2 and 3.

An electrical connection is made from ring 96 through conductor 98 to the switch 88 in the electrical circuit 86. The conductor 98 preferably extends on the inside of inflatable element 78 but may be extended along its exterior. Because of their axial extension, the axial contacts are more durable and less likely to be scraped off as the tool is moved down the casing. Torn or damaged contacts are still operative for contacting between the casing and packer when the latter is inflated if the torn contacts are still connected to ring 96.

A portion 93 of the axial contacts 94 are loose and have slack adjacent the fiber ring 96 when the inflatable element 78 is in its uninflated configuration as shown in FIG. 4. Upon inflation of inflatable element 78, the slack portions 93 straighten out to accommodate their outward extension on inflatable member 78 while maintaining electrical connection between the ring 80 and the upper portions of axial contacts 94.

Axial contacts 94 may be copper strips or copper wires, unbonded or preferably cemented or otherwise bonded to the outer surface of inflatable element 78. Preferably the contacts are inexpensive and easily replaced. For example, the axial contacts may be commercially available conductors available at about $5 per item so that they can be replaced before use if torn loose or damaged during a prior use. For example, when the packer 72 is deflated for removal, complete deflation often does not occur, and removal of the tool 46 when partially inflated may cause destruction or removal of the axial contacts 94 from the surface of the tool 46.

Figure 6:
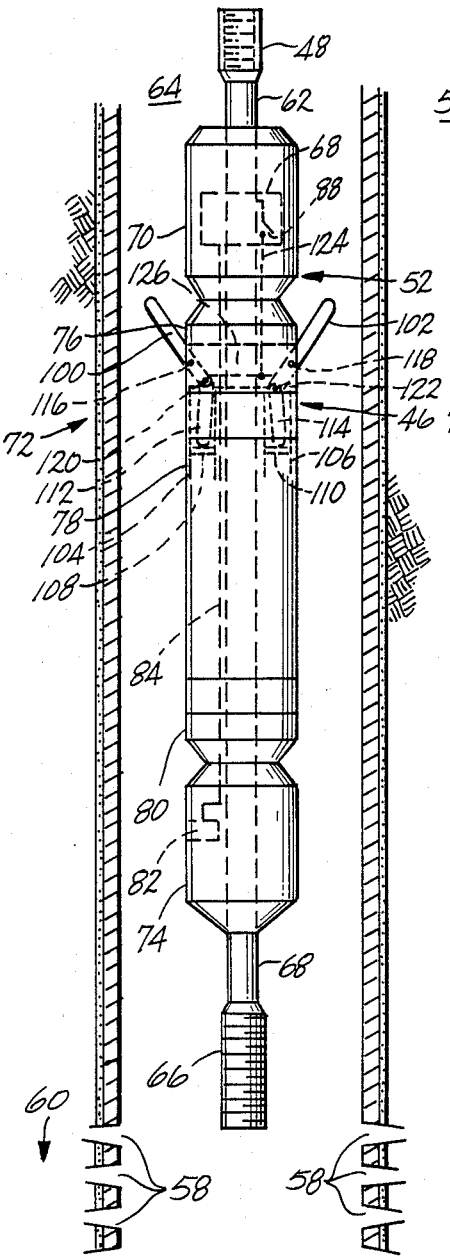
FIG. 6 is a schematic and cross-sectional view of casing and a schematic and side elevation view similar to that of FIG. 2 showing an alternate contact arrangement for contacting the casing in a data communication system and embodying the present invention.
Figure 7:
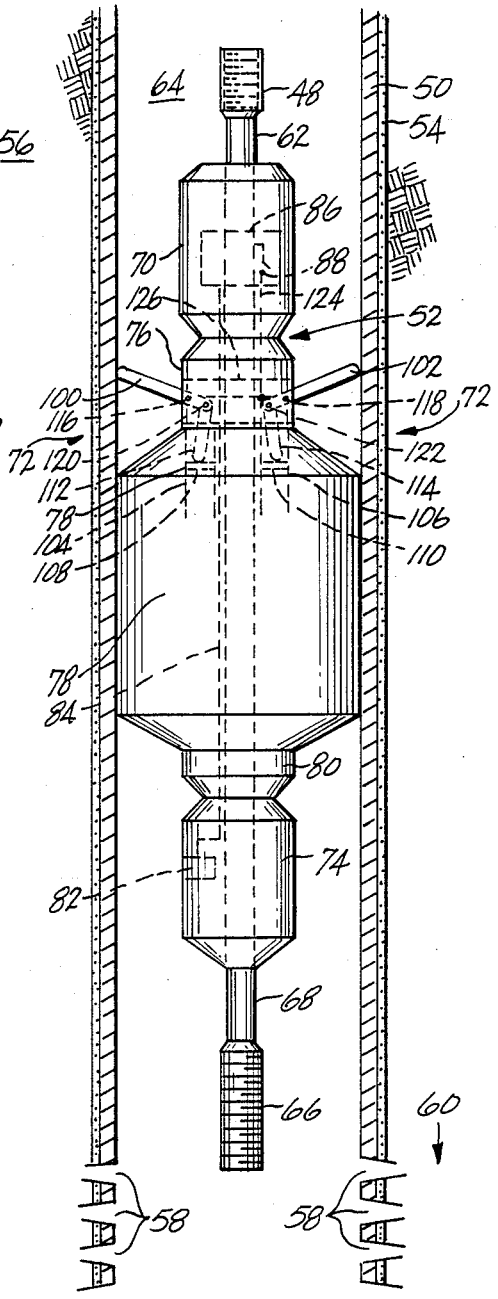
FIG. 7 is a schematic and side elevational view similar to that of FIG. 6 showing the contacts and packer actuated.

FIGS. 6 and 7 depict an alternate embodiment of the invention in which the means for contacting the casing 50 is a pair of lever arm contacts 100 and 102 for contacting the inner surface of casing 50. FIGS. 6 and 7 are essentially the same as FIGS. 2 and 3 except as otherwise indicated and the same reference numerals are used for the same parts. As shown in FIG. 6, the lever arm contacts 100 and 102 are initially retracted so that the contacts are as close as possible to the external surface of tool 46. Lever arm contacts 100 and 102 are extendable outwardly responsive to fluid pressure applied within the inflatable element 78 to actuate the inflatable element 78. To accomplish the fluid actuation, cylinders 104 and 106 have, respectively, pistons 108 and 110 slidably mounted therein. Lever arm contacts 100 and 102 are pivoted around pivot points 116 and 118. Lift rods 112 and 114 are coupled to the internal ends 120 and 122, respectively, of lever arm contacts 100 and 102. An increase in fluid pressure within the mandrel 62, and therefore in inflatable element 78, causes upward movement of pistons 108 and 110 which causes radial extension of lever arm contacts 100 and 102 through lift rods 112 and 114 into electrical contact with the inner wall of casing 50 as shown in FIG. 7. The lever arm contacts are maintained in the position as shown in FIG. 7 by the fluid pressure within the inflatable element 78 or once actuated could be latched in place by one-way valves or in any one of a number of ways conventional in the art.

The integrity of the electrical connection between the contacts and casing 50 is significant; however, the current flow is sufficiently low that the variations in contact resistance are not significant under normal conditions. However, with the large surface area over which the tubing and casing are coaxial with each other, the potential for electrical conduction or shorting between the tubing string and casing 50 can cause a problem if a fluid is used that is quite conductive. Therefore, the fluid in the well should be of relatively low conductivity so that there is little or no electrical conductance effect between the casing and tubing string due to the fluid. It is preferable that the fluid have a conductivity less than or equal to $10^{-4}$ ohms/meter. For example, a preferred fluid may be oil, distilled water or other nonconductive fluid.

Electrical connection between the lever arm contacts 100 and 102 to one side of switch 88 is made through a conductor 124. The conductor is connected either directly to contacts 100 and 102 or to some other conducting part such as pivots 120 and 122.

The conductive components of the lever arm contacts 100 and 102, the lift rods 112 and 114 are insulated from the mandrel 62 and other conductive components of tool 46 that are electrically connected to conductive mandrel 62. For example, the upper portion 76 in which the contacts 100 and 102 are mounted on a nonconductive bushing 126. The nonconductive bushing 126 serves to prevent electrical conduction between the contacts 100 and 102 and the mandrel 62 and, therefore, the tubing (not shown) going to the top of the well.

With the embodiments of FIGS. 1–7, an AC signal is applied between the casing and the tubing. The signal is conducted along the casing and the tubing to the location of the tool, through the contacts on the tool to the switch.

When the switch (i.e., switch 88 of FIGS. 6 and 7) is open, the conductance between the tubing and casing is one value and is a high impedance. When the switch is closed the conductance between the tubing and casing will be a second value and is essentially a short circuit. Therefore, when a constant magnitude voltage AC signal is applied between the casing and tubing, different amounts of current flow depending on the conductance existing between the casing and tubing through the switch.

Figure 8:
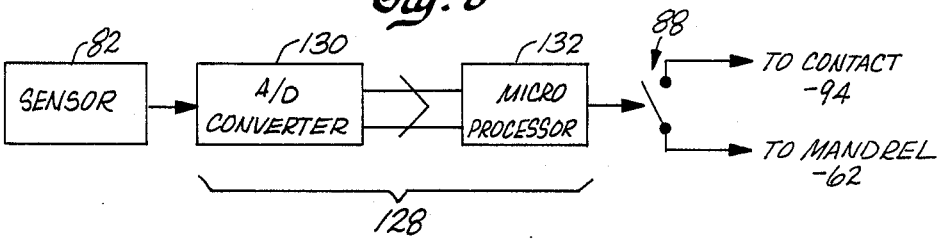
FIG. 8 is a schematic and block diagram of a pressure sensor, switch and circuit for connecting the tubing and casing for use in the data communication systems of FIGS. 1–7.

Refer now to FIG. 8, wherein the electronic circuit 68 used in FIGS. 5 and 6 is depicted as switch electronics unit 128 and is coupled to the pressure sensor 82. The output of the pressure sensor 82 is an analog signal representative of the parameter, pressure, and is coupled to the input of analog-to-digital converter 130. The analog-to-digital converter 130 converts the analog signal to parallel digital data signals for microprocessor 132. Microprocessor 132 encodes the digital data signals using classical error correcting encoding methods. The encoded digital pressure signal is then converted to a clocked serial bit stream to form control signals. The microprocessor provides the control signals to the switch 88, causing the switch 88 to open and close in a pattern, representative of the pressure signals from sensor 82. Opposite sides of input/output circuit of switch 88 are connected to the mandrel 62 and to the contacts 94 on packer 72. When the microprocessor 132 opens switch 88, a high-impedance or open circuit is presented between the tubing and casing. When the microprocessor 132 closes switch 88, the casing and tubing are electrically shorted together providing a low-impedance between the casing and tubing.

The microprocessor 132 is programmed to form control signals for switch 88 in a redundant code so that, should errors develop in a signal sensed at the top of the well, the true pressure data can be recovered. Circuits similar to FIG. 8 can be employed in the embodiments of of the tool, through the contacts on the tool to the switch.

When the switch (i.e., switch 88 of FIGS. 6 and 7) is open, the conductance between the tubing and casing is one value and is a high impedance. When the switch is closed, the conductance between the tubing and casing will be a second value and is essentially a short circuit. Therefore, when a constant magnitude voltage AC signal is applied between the casing and tubing, different amounts of current flow depending on the conductance existing between the casing and tubing through the switch.

Refer now to FIG. 8, wherein the electronic circuit 68 used in FIGS. 5 and 6 is depicted as switch electronics unit 128 and is coupled to the pressure sensor 82. The output of the pressure sensor 82 is an analog signal representative of the parameter, pressure, and is coupled to the input of analog-to-digital converter 130. The analog-to-digital converter 130 converts the analog signal to digital data signals for microprocessor 132. Microprocessor 132 processes the digital data signals and provides control signals to the switch 88, causing the switch 88 to open and close in a pattern, representative of the pressure signals from sensor 82. Opposite sides of input/output circuit of switch 88 are connected to the mandrel 62 and to the contacts 94 on packer 72. When the microprocessor 132 opens switch 88, a high-impedance or open circuit is presented between the tubing and casing. When the microprocessor 132 closes switch 88, the casing and tubing are electrically shorted together providing a low-impedance between the casing and tubing.

The microprocessor 132 is programmed to form control signals for switch 88 in a redundant code so that, should errors develop in a signal sensed at the top of the well, the true pressure data can be recovered. Circuits similar to FIG. 8 can be employed in the embodiments of FIGS. 1–3, 6 and 7.

Figure 9C:
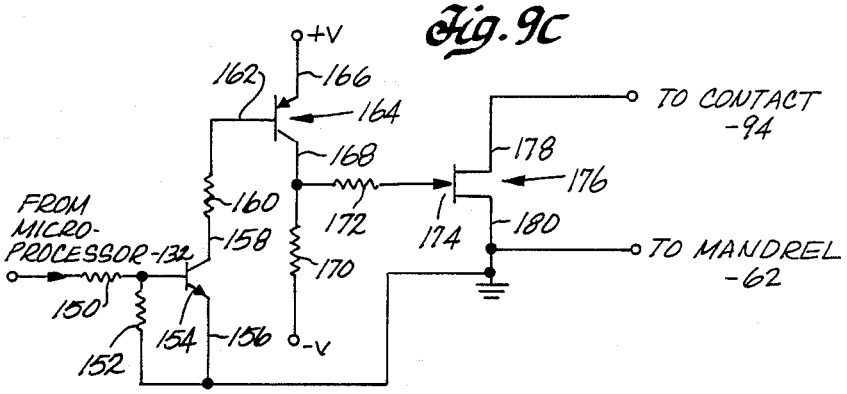
FIGS. 9A–9C each show a schematic diagram of a different switch for use in the circuit of FIG. 8.
Figure 9A:
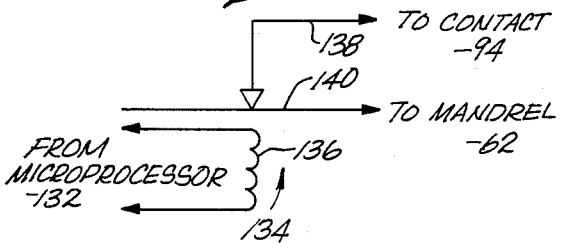

FIG. 9A depicts a specific embodiment of the switch 88 of FIG. 8. Specifically, a relay switch 134 has its solenoid coil 136 connected across the output of the microprocessor 132 (FIG. 8). Its open and closed contacts 138 and 140 are connected respectively to the contacts and to the mandrel.

Figure 9B:
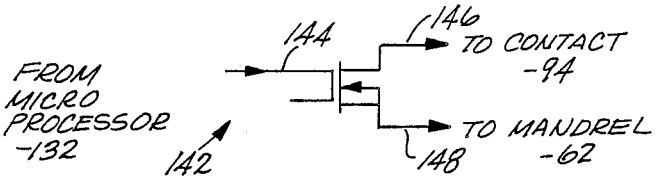

FIG. 9B depicts a further embodiment of the switch 88 of FIG. 8 in the form of a semiconductor circuit. Specifically, the switch includes a MOSFET 142, the gate 144 of which is coupled to the output of microprocessor 132, and wherein the drain 146 and source 148 of the MOSFET are coupled to the contacts and mandrel, respectively.

FIG. 9C depicts a preferred semiconductor circuit for the switch 88. The output of the microprocessor 132 is coupled to a resistor 150, which in turn is grounded through resistor 152 and also is coupled to the base of NPN transistor 154. The emitter 156 of transistor 154 is grounded, and its collector 158 is coupled through resistor 160 to the base 162 of PNP transistor 164. PNP transistor 164 has its emitter 166 coupled to a source of positive potential +V and its collector 168 connected through resistor 170 to a negative source of potential −V. The collector 168 is also coupled through resistor 172 to the gate 174 of junction field effect transistor (JFET) 176. The JFET 176, by way of example, is a symmetric N-channel JFET having a low "on" resistance between electrodes 178 and 180 and a high "off" resistance therebetween. The electrode 178 is coupled to the contacts, and the electrode 180 is coupled to the mandrel. The mandrel is grounded to the same ground source as resistor 152 and emitter 156.

The AC signal source preferably has a frequency in the range of 20 to 100 hertz, although other frequencies may be used depending on the circuitry and application. Preferably the source of power for the switching circuit, the microprocessor, the analog-to-digital converter and the sensor is supplied by one or possibly two lithium battery cells each with an output of about 1 watt of power and 3 volts. Appropriate direct current inverters and regulators are used to step up the voltage to the required levels. It is anticipated that such a battery or batteries would have about a 1-week life with the circuits disclosed in FIGS. 8 and 9C.

Figure 10:
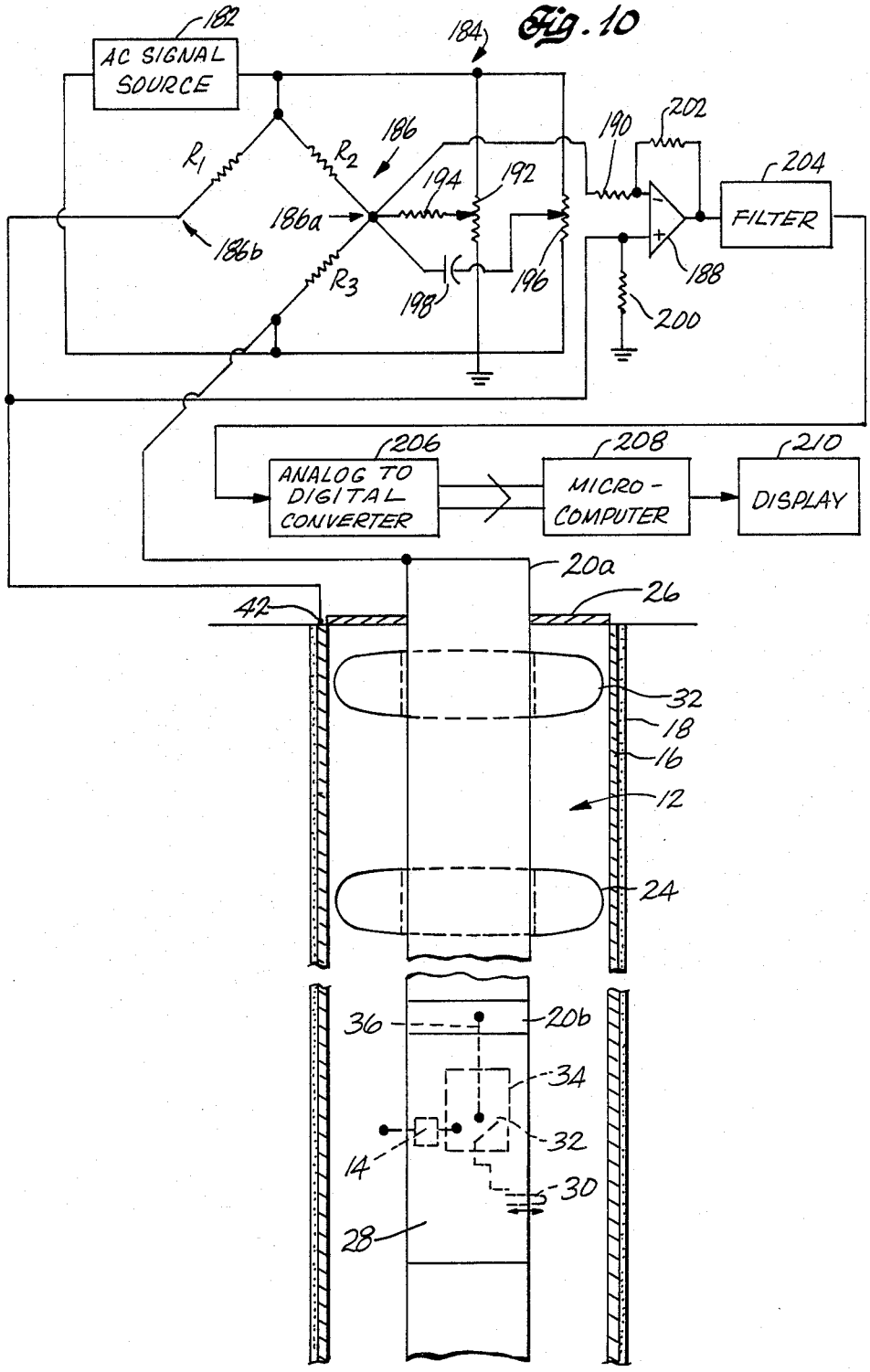
FIG. 10 is a schematic view similar to that of FIG. 1 showing a preferred signal source and detection system for use at the top of the well in the data communication systems of FIGS. 1–7.

FIG. 10 is a schematic diagram of a preferred embodiment of the invention employing a voltage AC signal source and a bridge-type sensor. Although source 182 is preferably a constant voltage source, it may be replaced with a constant current source with appropriate changes in the bridge sensing circuit, as is evident to those skilled in the art.

A voltage sensor 184 has a bridge circuit 186 coupled between the upper end 42 of casing 16 and the upper portion **20*a* of the tubing string 20. The bridge has a resistor $R_1$ coupled to the end 42 and to the noninverting input of a differential amplifier 188**.

The other lead of the resistor $R_1$ is coupled to one side of the output from the AC signal source 182 and to a first lead of resistor $R_2$. The first lead of second resistor $R_2$ is coupled to the one side of the output of the AC signal source, and the second lead of second resistor $R_2$ is coupled to the first lead of a third resistor $R_3$, to the inverting input of the differential amplifier 188 through a resistor 190, to a first variable resistor 192 through a resistor 194, and to a second variable resistor 196 through a capacitor 198. The first lead of the third resistor $R_3$ is also coupled to the inverting input of the differential amplifier 188 through resistor 190, to the variable resistor 192 through resistor 194 and to variable resistor 196 through capacitor 198. The second lead of the third resistor $R_3$ is coupled to the upper end 20*a* of the tubing string 20. A bridge is formed thereby wherein the second and third resistors $R_2$ and $R_3$ are of the same resistive value, and first resistor has a different value. The casing-tubing circuit, in effect, consititutes a fourth resistor between terminals 186*a* and 186*b* in the bridge. The second side of the output from AC signal source 182 is coupled to ground. The first lead of variable resistor 192 is coupled to the first side of the output of the AC signal source 182, and the second lead of resistor 192 is coupled to ground. The variable resistor 196 is coupled in parallel to variable resistor 192, the first lead being coupled to the first electrode of the AC signal source, the second lead of variable resistor 196 being coupled to ground.

Variable resistor 192 constitutes a coarse null for balancing the circuit, depending on the various bulk resistances and on the particular well. The phase null 196 nulls the phase differences in the amplitude of the voltage. Nulling can be done manually or by computer. The noninverting input to the differential amplifier 188 is grounded through resistor 200. Feedback for the differential amplifier 188 to the inverting input of the differential amplifier is made through resistor 202. The output of differential amplifier 188 is coupled to a filter 204 for enhancing the signal-to-noise ratio for the detected signal. Filter 204 is preferably a band pass filter. The band pass is very narrow and only passes frequencies very close to the frequency of the AC signal source 182. As a result, unwanted noise is filtered out.

The output of filter 204 is coupled to an analog-to-digital converter 206, the output of which is coupled to a microcomputer 208. The microcomputer 208 then provides output to a display 210, which may be a chart recorder, a digital display or a graphics display.

The AC signal source 182 is preferably a narrow band signal source, operating at a frequency of between 1 and 10 Hertz and possibly as high as 100 Hertz. The differential amplifier 188 raises the low voltage output from bridge 186 (across terminals 186*a* and 186*b*) which is in the range of microvolts, up to voltage in order of 0.1 volts.

The analog-to-digital converter 206 is preferably a 16 bit converter and converts the serial analog coded information represented by the changes in voltage between terminals 186*a* and 186*b* to a parallel digital code capable of being interpreted by the microcomputer 208 for outputting or storing the data. Preferably, the data communicated from downhole includes redundant bits of information to enhance the reliability of the data received. The microcomputer 208 converts the redundantly coded information to an intelligible format. By manipulating the circuit, the change in conductance in the casing, as a result of the opening and closing of switch 88, of approximately 0.3% can be amplified to approximately 10% change.

In operation, the tool 46 of FIGS. 4 and 5 is made up in the tubing string at the top of the well before the tubing string is run into the well inside casing 16. The tool is placed in the well immediately above the casing apertures 58 (FIG. 4) and a relatively low conductivity fluid is forced down the tubing string 20 and through mandrel 62. The pressurized flow of fluid along mandrel 62 inflates the inflatable element 78, expanding it outwardly so that axial contacts 94 come into electrical contact with the adjacent casing section. As a result, electrical contact and a circuit is formed from the AC source at the top of the well across the opposite sides of switch 88 through the casing and the tubing string. The poppet valves close off the inflatable element so that the element 78 and contacts 94 remain in intimate contact with the adjacent casing.

Fracturing fluid can then be forced through the tubing and a mandrel through openings 58 to the producing zone 60. The pressure in the fracturing fluid below the packer 72 is sensed by sensor 82.

The analog-to-digital converter 130 (FIG. 8) converts the analog signal from sensor 82 to digital form. The microprocessor 132 controls the operation of switch 88 to short and open the connection between the casing and tubing via contacts 94 and mandrel 62. In this fashion, the tubing and casing may be alternately electrically connected and disconnected, changing the conductance representative of the pressure data.

The AC signal source 182 applies a signal between the casing and tubing string. The changing conductance between the casing and tubing causes changes in the applied signal. The sensor circuit 184 (FIG. 10) senses the changes in applied signal caused by the changing conductance and provides output to display 210. The display parameter may then be used to make appropriate changes or adjustments in the fracturing process as is known in the art.

It will now be understood that the disclosed system does not transmit energy from the tool up the well as in some prior art systems. By way of contrast, the energy, in the form of the AC signals, is applied at the top of the well between the casing and tubing. The switch in the tool down the well changes conductance between the tubing and casing. The AC signal source is used to interrogate the changes in conductance and to retrieve the data at the top of the well. Viewing it differently, the changes in conductance between the tubing and casing cause changes in the applied signal which are sensed and used to retrieve the data at the top of the well.

Although an exemplary embodiment of the invention has been discloses for purposes of illustration, it will be understood that various changes, modifications, and substitutions may be incorporated into such embodiment without departing from the spirit of the invention as defined by the claims appearing hereinafter.

What is claimed is:

1. An apparatus for communicating data, representing a parameter, in one of an oil and a gas well uphole comprising:

a well casing extending into the well for conducting current;

a tubing string disposed within the casing for conducting current and extending into the well;

a coupling coupled to the tubing string;

a packing tool supported by and electrically coupled to the coupling and adapted for conducting current in conjunction with the casing and the tubing string, the packing tool comprising an inflatable packer, means coupled to the tubing string for sensing the parameter and producing an analog signal representative of the parameter and comprising an electronic circuit for converting the analog signal to a coded digital signal representative of the parameter, said means coupled to the tubing string further comprising switch means driven by the coded digital signal for electrically coupling together and decoupling the casing and the tubing string, contact means coupled to the switch means and disposed along the packing tool for contacting the casing when the inflatable packer is in an inflated condition to thereby complete an electrical circuit between the switch means and the casing; and means uphole from the packing tool for preventing electrical contact between the casing and the tubing string.

2. Apparatus for communicating data in a well, the apparatus comprising:

an electrically conductive well casing in the well;

an electrically conductive tubing extending inside the casing and electrically separated therefrom;

a packing tool supported by and electrically coupled to the tubing comprising an outwardly distendable nonconductive packing element and an electrical contact mounted on the packing element for electrically contacting the casing when the packing element is distended;

electrical switch means for alternatively electrically connecting and disconnecting the tubing to the contact to create a changing conductance representative of the data; and means for interrogating the changing conductance with an alternating current signal, formed at the top of the well, for retrieving the data.

3. Apparatus for communicating data up a well, the apparatus comprising:

an electrically conductive tubular shaped casing in the well;

an electrically conductive tubing extending inside the casing and having an electrical separation therefrom;

a tool supported by the tubing inside the casing and comprising an electrical contact for electrically contacting the casing;

switch means for alternately electrically coupling and decoupling the tubing to the contact causing changes in the electrical conductance, between the casing and the tubing, representative of data;

means for applying, at the top of the well, an alternating current signal between the tubing and casing; and means coupled, at the top of the well, to at least one of the tubing and the casing for determining the changes in conductance and, for recovery of the data.

4. A tool for communicating information up a well, the well having a string of tubing disposed within, and electrically isolated from, a casing, the tubing and casing extending to the top of the well, the tool comprising:

a generally cylindrical outer perimeter adapted for insertion in a passage in the casing;

an electrically conductive coupling for mechanically and electrically connecting the tool to the lower end of the tubing string;

an electrical contact mounted on the tool and actuable outwardly for electrically contacting the inside of the casing and;

switch means mounted on the tool for alternately electrically connecting together and disconnecting the contact to the coupling to thereby change the electrical conductance presented to an electrical signal applied at the top of the well between the tubing and casing.

5. A tool as defined in claim 4 wherein the tool is made of electrically conductive material, the tool comprising electrically nonconductive means for electrically isolating the contact from the electrically conductive material.

6. A tool as defined in claim 5 wherein the tool comprises a housing that is electrically conductive and the electrically nonconductive means isolates the contact from the housing.

7. A tool as defined in claim 5 wherein the tool comprises fluid actuated means for actuating the contact outward into electrical contact with the casing.

8. A tool as defined in claim 4 wherein the tool comprises a packer, for sealing in the annulus between the tubing and the casing of the well, having a nonconductive outer portion which is actuable outward in response to an applied fluid for engaging the inside of the casing.

9. A tool as defined in claim 8 wherein the contact is mounted on the exterior of the nonconductive outer portion of the packer.

10. A tool as defined in claim 8 wherein the contact is mounted adjacent the nonconductive outer portion of the packer, the apparatus further comprising means responsive to fluid pressure applied to the packer for actuating the contact outward into contact with the casing.

11. A tool as defined in claim 4 comprising a pressure sensor for sensing pressure adjacent the tool and means responsive to the pressure sensor for controlling the operation of the switch means.

12. A tool as defined in claim 11 wherein the means for controlling the switch means comprises a data processor.

13. A method for transmitting data up a well to the top of the well comprising the steps of:

lowering a string of electrically conductive tubing and a tool connected to an end of the tubing down the well along the inside of the tubular shaped electrically conductive casing for the well;

electrically contacting a location on the inside of the casing with an electrical contact carried by the tool;

operating a switch in the tool after lowering for alternately electrically connecting and disconnecting the contact, and thereby the casing, with respect to the conductive tubing for causing a changing electrical conductance between the tubing and the casing to thereby represent the data; and interrogating the changing electrical conductance with an alternating current signal, formed applied between the tubing and casing at the top of the well, for retrieving the data.

14. A method according to claim 13 wherein the step of interrogating comprises the steps of:

applying an alternating current signal, at the top of the well, between one of the casing and the tubing; and sensing the changes in the applied signal caused by the changes in conductance to retrieve the data at the top of the well.

15. A method according to claim 13 wherein the step of electrically contacting a location comprises the step of applying a fluid pressure in the tubing string, causing the electrical contact to move outward into contact with the casing.

16. A method according to claim 13 wherein the tool comprises a packer and contact is mounted on the periphery of a nonconductive inflator on the packer, the step of contacting comprising the step of applying a fluid pressure to the packer, causing the inflator to extend outward and form an electrical contact between the contact and the casing.

17. A method according to claim 13 comprising the step of sensing a parameter in the well and controlling the operation of the switch representative of the parameter.

18. A method according to claim 17 wherein the step of sensing a parameter comprises the step of sensing pressure adjacent the tool.

* * * * *

UNITED STATES PATENT AND TRADEMARK OFFICE

CERTIFICATE OF CORRECTION

PATENT NO. : 4,845,494

DATED : July 4, 1989

INVENTOR(S) : M.E. Hanson; P.F. Titchener

It is certified that error appears in the above-identified patent and that said Letters Patent is hereby corrected as shown below:

In the Specification:

Column 5, line 15, after "32" delete "25".

Column 9, line 39, delete the second "of".

Column 12, line 50, change "discloses" to -- disclosed --.

In the Claims:

Column 12, line 57, insert a comma after "gas".

Column 13, line 64, after "perimeter" delete "adapted".

Column 14, line 3, change "and;" to -- ; and --.
Column 14, line 61, before "applied" delete "formed".

Signed and Sealed this

Twenty-eighth Day of August, 1990

*Attest:*

HARRY F. MANBECK, JR.

*Attesting Officer*

*Commissioner of Patents and Trademarks*